US010737511B2

(12) United States Patent
Yoda

(10) Patent No.: US 10,737,511 B2
(45) Date of Patent: Aug. 11, 2020

(54) DRYING APPARATUS AND PRINTING APPARATUS

(71) Applicant: SEIKO EPSON CORPORATION, Tokyo (JP)

(72) Inventor: Tomohiro Yoda, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/020,472

(22) Filed: Jun. 27, 2018

(65) Prior Publication Data

US 2019/0001707 A1 Jan. 3, 2019

(30) Foreign Application Priority Data

Jun. 28, 2017 (JP) ..... 2017-125920

(51) Int. Cl.
*F26B 5/06* (2006.01)
*B41J 11/00* (2006.01)

(52) U.S. Cl.
CPC ..... *B41J 11/002* (2013.01)

(58) Field of Classification Search
USPC ..... 399/341
See application file for complete search history.

(56) References Cited

U.S. PATENT DOCUMENTS 6,272,310 B1 * 8/2001 Blair ..... G03G 15/2021 219/216
6,463,674 B1 * 10/2002 Meyers ..... B41J 11/002 34/304
8,667,995 B1 * 3/2014 Fanelli ..... F24F 13/0245 138/112

FOREIGN PATENT DOCUMENTS

JP 2015-136859 A 7/2015
JP 2017-125920 7/2015

* cited by examiner

*Primary Examiner* — Lam S Nguyen
(74) *Attorney, Agent, or Firm* — Workman Nydegger

(57) ABSTRACT

A drying apparatus includes a heating mechanism arranged so as to heat a medium supported by a support surface, an air sending path that includes an air intake port through which outside air is introduced and an air outlet port that opens to the support surface, and an air blower arranged so as to flow gas in the air sending path toward the air outlet port. The air sending path may include an inside layer that can suppress ventilation and a heat insulating layer that is arranged superimposed on an outside of the inside layer.

6 Claims, 2 Drawing Sheets

DRYING APPARATUS AND PRINTING APPARATUS

The entire disclosure of Japanese Patent Application No. 2017-125920, filed Jun. 28, 2017 is incorporated by reference herein.

BACKGROUND

1. Technical Field

Embodiments of the present invention relate to a drying apparatus that accelerates drying of printed matter and a printing apparatus such as a printer.

2. Related Art

A printing apparatus that performs printing on a medium such as paper may include a drying apparatus that dries printed matter (for example, JP-A-2015-136859) or that dries the liquid that has been deposited on the medium.

When the temperature in a housing of the printing apparatus is raised by heating, dew condensation may occur in the housing due to a temperature difference from the outside.

SUMMARY

An advantage of some aspects of the invention is to provide a drying apparatus and a printing apparatus where dew condensation hardly occurs. Embodiments of the invention allow a printed matter to be heated without causing condensation or by minimizing the amount of condensation.

The aforementioned drying apparatus includes a heating mechanism arranged so as to heat a medium supported by a support surface, an air sending path that includes an air intake port through which outside air is introduced and an air outlet port that opens to the support surface, and an air blower arranged so as to flow gas in the air sending path toward the air outlet port. The air blower thus causes air or gas to flow introduced through the air intake port towards the air outlet port along the air sending path. The air sending path includes an inside layer that can suppress ventilation and a heat insulating layer that is arranged such that the heat insulating layer is superimposed on an outside of the inside layer.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Hereinafter, an embodiment of a printing apparatus will be described with reference to the drawings. The printing apparatus may be, for example, an ink jet printer that performs printing on a medium such as a paper sheet by ejecting a liquid such that the liquid lands on the medium. Ink is an example of a liquid.

Figure 1:
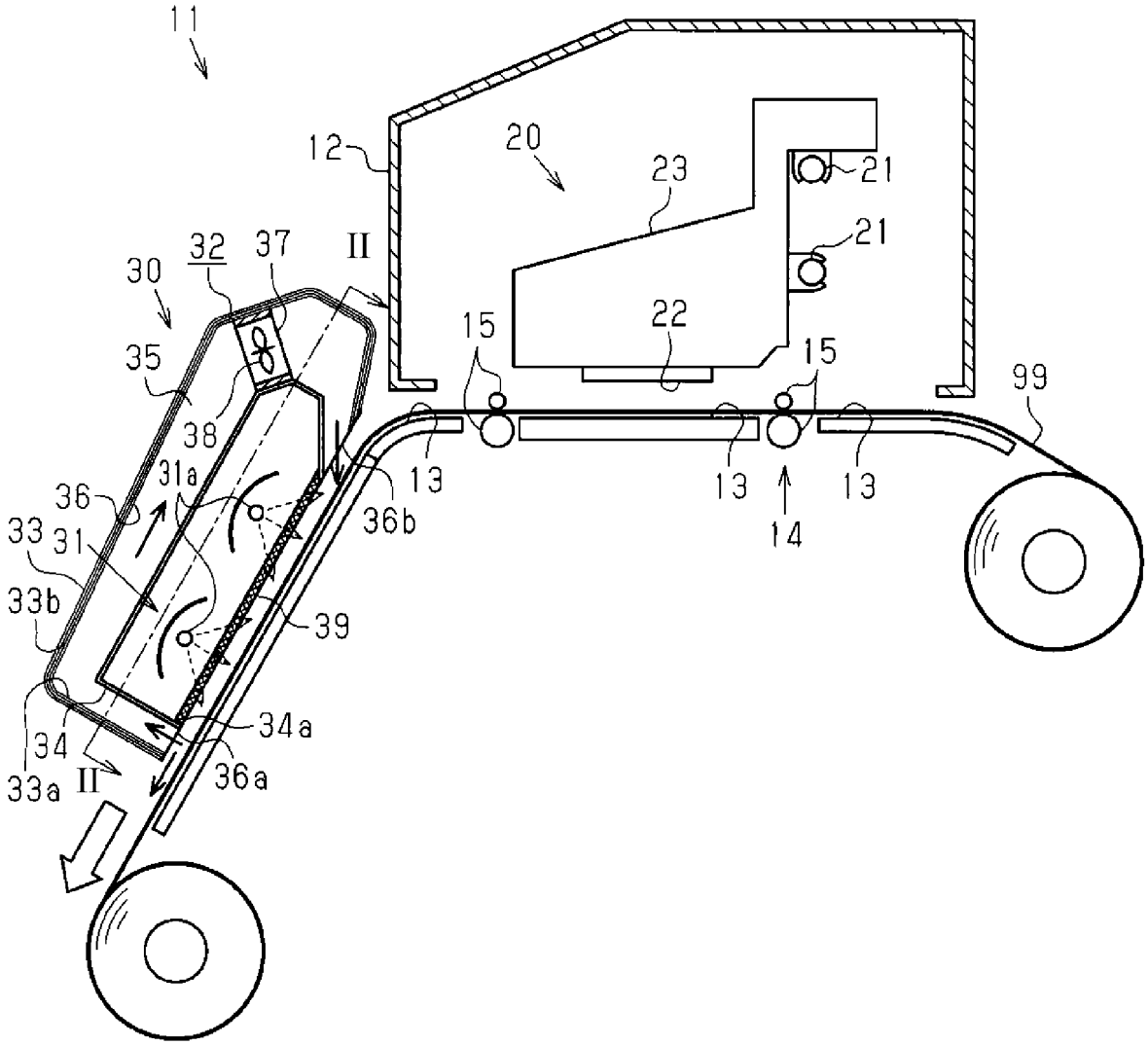
FIG. 1 is an entire configuration diagram of a drying apparatus and a printing apparatus of an embodiment.

As shown in FIG. 1, a printing apparatus is illustrated. The printing apparatus 11 may include a housing body 12, a support surface 13 that can support a medium 99, a transport mechanism 14 that transports the medium 99 along the support surface 13, a printing mechanism 20 arranged in the housing body 12, and a drying apparatus 30 arranged outside the housing body 12. The medium 99 is, for example, rolled paper wound in a cylindrical shape. As the rolled paper unwinds, the medium is fed along a transport path along the support surface. After printing, the medium may be wound up into a rolled or cylindrical shape. The transport mechanism 14 may include, for example, a plurality of transport rollers 15 that rotate in a state of being in contact with the medium 99.

The printing mechanism 20 is configured to include a print head 22 that ejects ink and performs printing on the medium 99. The printing mechanism 20 may include a carriage 23 that holds the print head 22 and a guide shaft 21 that guides movement of the carriage 23. In this case, the print head 22 ejects ink while reciprocating with the carriage 23.

The drying apparatus 30 may be positioned downstream of the printing mechanism 20. The drying apparatus 30 may include a heating mechanism 31, a housing 32 that houses the heating mechanism 31, an air sending path 36, and an air blower 37. The heating mechanism 31 is arranged in a position facing the support surface 13 so as to heat the medium 99 supported by the support surface 13. The heating mechanism 31 may include a heating element. The heating element may include, for example, a plurality of heater tubes 31*a* arranged along the support surface 13. The heater tubes 31*a* may face the surface 13 or the medium with nothing between the heater tubes 31*a* and the surface 13 or the medium. Alternatively, structure such as a wire net 39 may be interposed between the heater tubes 31*a* and the surface 13 or the medium.

The air blower 37 may be a fan 38 arranged in the air sending path 36. A plurality of fans 38 may be provided so as to be arranged along a width direction of the medium 99. Thus, the width of the air sending path 36 may be sufficient, in a direction that is transverse to the transport direction, to accommodate the plurality of fans 38.

The housing 32 may include an inner wall 34 surrounding or partially surrounding the heating mechanism 31, an outer wall 33 arranged outside the inner wall 34, and a pair of side walls 35 crossing the outer wall 33 and the inner wall 35. The outer wall 33, the inner wall 34, and the side walls 35 form or define the air sending path 36. The air sending path 36 may include an air intake port 36*a* through which outside air is introduced and an air outlet port 36*b* that opens to the support surface 13. In one example, the air sending path 36 is arranged so as to surround or partially surround the heating mechanism 31. The intake port 36*a* may be downstream of the air outlet port 36*b*. Both ports may open or face the support surface 13.

The air blower 37 is arranged so as to flow gas in the air sending path 36 toward the air outlet port 36*b*. When the air blower 37 is arranged in the air sending path 36, it is possible to suppress upsizing of the drying apparatus 30. In other words, arranging the air blower 37 in the air sending path 36 helps constrain the size of the drying apparatus 30. When the outer wall 33 and the inner wall 34 are bent, it is possible to change a flowing direction of the gas in the air sending path 36. In this example, the air flow path includes curved or bent portions and straight portions.

When narrowing the air sending path 36 by gradually reducing a distance between the outer wall 33 and the inner wall 34 toward the air outlet port 36*b*, it is possible to increase wind velocity of wind or gas blowing from the air outlet port 36*b*. At this time, it is preferable to extend a downstream portion of the air sending path 36 connected to the air outlet port 36*b* so that the downstream portion is inclined with respect to the support surface 13 and the wind or gas blowing from the air outlet port 36*b* flows in a transport direction of the medium 99 (a direction shown by a hollow arrow in FIGS. 1 and 2). Thus, the gas exiting the air outlet port 36*b* is not in a direction that is perpendicular to the support surface 13.

In one example, the air intake port 36*a* opens to the support surface 13. The heating mechanism 31 may be arranged or positioned between the air outlet port 36*b* and the air intake port 36*a*. By doing so, the wind or gas blown from the air outlet port 36*b* passes through a region heated by the heating mechanism 31. By passing the air through this region, evaporation of a liquid contained in the medium 99 is accelerated. In other words, when water vapor remains over or is present above the surface of the medium 99, it is difficult to evaporate the liquid. In this regard, when the water vapor generated by the heating is quickly removed from the surface of the medium 99 by blowing air, it is possible to continuously evaporate the liquid from the printed matter or from the printed medium.

The housing 32 may include a heating opening 34*a* arranged to face the support surface 13. In one example, a wire net 39 is arranged to or across the heating opening 34*a*. By doing so, the heat of or generated by the heater tubes 31*a* is transmitted to the medium 99 on the support surface 13 through the wire net 39. Further, it is possible to perform control (or control operations of the apparatus) so that an air flow going from the air outlet port 36*b* to the air intake port 36*a* along the support surface 13 flows along the wire net 39.

Figure 2:
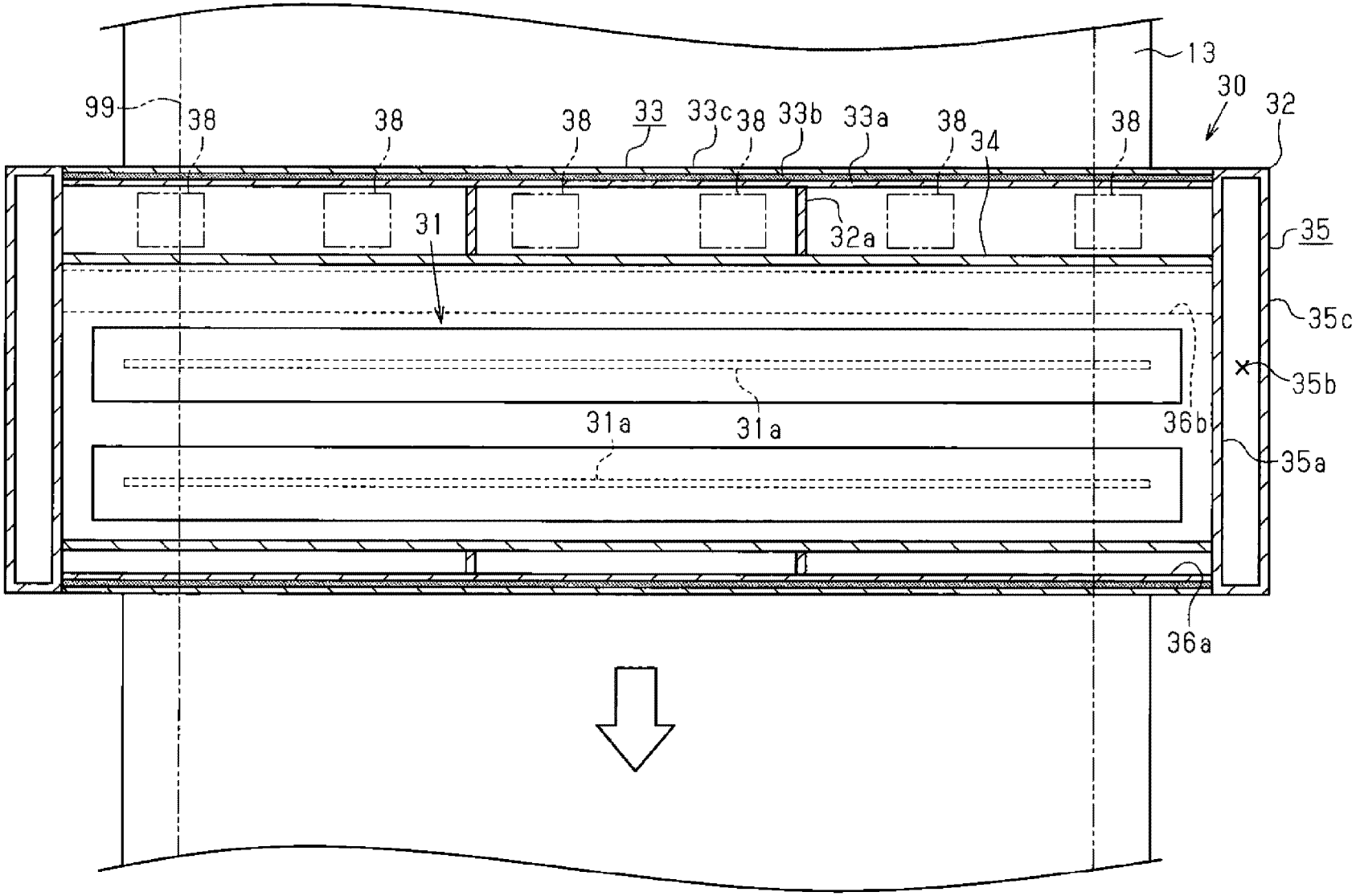
FIG. 2 is a cross-sectional view taken along line II-II in FIG. 1.

As shown in FIG. 2, the outer wall 33 that constitutes the air sending path 36 (or an outside portion of the air sending path 36) has an inside layer 33*a* that can suppress ventilation and a heat insulating layer 33*b* that is arranged superimposed on the outside of the inside layer 33*a*. In other words, the inside layer 33*a* is positioned between the heat insulating layer 33*b* and the or the air sending path 36. The heat insulating layer 33*b* is useful for improving safety when a user touches the drying apparatus 30 because the inside of the drying apparatus 30 can reach a high temperature. Further, in one example, a three-layer structure is formed by providing an outside layer 33*c*. The outside layer 33*c* is arranged superimposed on the outside of the heat insulating layer 33*b*. Thus, the heat insulating layer 33*b* is positioned between the inside layer 33*a* and the outside layer 33*c*.

The inside layer 33*a* and the outside layer 33*c* may be composed of a plate-like member such as a sheet metal having a gas barrier property for suppressing ventilation. By suppressing ventilation, water vapor in the air sending path 36 remains inside the inside layer 33*a* or inside the air sending path 36 and does not move to the heat insulating layer 33*b*.

Although the heat insulating layer 33*b* may be an air layer or a vacuum layer, it is preferable that the heat insulating layer 33*b* is composed of a heat insulating material sandwiched by the inside layer 33*a* and the outside layer 33*c*. As the heat insulating material, it is possible to employ, for example, nonwoven fabric, porous material, and/or foamed plastic. Regarding the plate-like member constituting the outer wall 33, thinner outer walls are lighter but also weaker. In this regard, when a heat insulating material is sandwiched between the inside layer 33*a* and the outside layer 33*c*, the strength of the housing 32 increases.

The air sending path 36 may be divided into a plurality of regions in a width direction. In this case, the fans 38 may be arranged in each divided region. For example, two fans 38 may be arranged at a predetermined interval in each divided region.

When a rib 32*a* for dividing the air sending path 36 in the width direction is provided to or in the housing 32, the strength of the housing 32 increases. One long opening extending in the width direction may be provided for each of the air intake port 36*a* and the air outlet port 36*b*, or the long openings may be divided in the width direction.

The side wall 35 may have a multi-layer structure in the same manner as or that is similar to the multi-layer structure of the outer wall 33. For example, the side wall 35 may have an inside layer 35*a* that can suppress ventilation and an outside layer 35*c* located outside the inside layer 35*a*, and a heat insulating layer 35*b* located between the inside layer 35*a* and the outside layer 35*c*. The inside layer 35*a* and the outside layer 35*c* of the present embodiment may be composed of a sheet metal, and the heat insulating layer 35*b* may be an air layer. In this case, a space formed between the inside layer 35*a* and the outside layer 35*c* may be closed and may be formed to prevent external air from entering the heat insulating layer 35*b*. The thickness of the heat insulating layer 35*b* may be different from a thickness of the layer 33*b*. Wiring connected to the heating mechanism 31 or the air blower 37 may be housed in the heat insulating layer 35*b*. The heat insulating layer 35*b* may be an air layer.

Next, an action or operation of the drying apparatus 30 and the printing apparatus 11 will be described.

When a printed medium 99 is transported along the support surface 13 and reaches a drying region formed between the drying apparatus 30 and the support surface 13, evaporation of a liquid attached to or permeated into the medium 99 is accelerated by heat generated by the heater tubes 31*a* and the wind or gas (air) blown from the air outlet port 36*b*. In this way, the drying apparatus 30 accelerates drying of the medium 99 by heating the medium 99 while blowing wind or gas.

A part of the gas that is blown from the air outlet port 36*b* and passes through the drying region is sucked in through the air intake port 36*a* and enters into the air sending path 36. The gas flowing from the drying region into the air sending path 36 is heated (by passing through the drying region), so that the temperature of the gas blowing from the air outlet port 36*b* is higher than a temperature of the gas when the air intake port 36*a* sucks gas from a region other than the drying region. Further, when the air sending path 36 is arranged so as to surround the heating mechanism 31, the temperature in the air sending path 36 is raised by the heat generated from the heating mechanism 31. Thus it is possible to collect the heat generated by the heater tubes 31*a* and reuse the heat for drying, so that heat efficiency is good.

When the gas flowing from the drying region contains water vapor evaporated from the medium 99, the amount of water vapor in the air sending path 36 increases. When the temperature in the air sending path 36 rises, the amount of saturated water vapor of the gas in the air sending path 36 increases. Thus, a large amount of water vapor can be contained in the air sending path 36 or in the air contained in the air sending path 36.

When a high temperature gas containing water vapor in the air sending path 36 comes into contact with the outer wall 33 and is cooled down, dew condensation may occur due to a decrease in the amount of saturated water vapor. For example, it is assumed that when the temperature of the heating mechanism 31 during driving or when performing drying is 60 to 80° C., the temperature of gas outside the housing 32 (outside air) is 20° C. If the outer wall 33 is composed of only the outside layer 33*c* and does not have the heat insulating layer 33*b* and the inside layer 33*a*, a temperature difference of 40 to 60° C. may occur between the inside and the outside of the outer wall 33.

Alternatively, if the outer wall 33 does not have the inside layer 33*a*, which can suppress ventilation, inside the heat insulating layer 33*b*, there is a probability that water vapor in the air sending path 36 enters into the heat insulating material constituting the heat insulating layer 33*b* and is cooled down by the outside air to form dew condensation. As a result, there is a risk that a dew condensed liquid drips down from the air intake port 36*a* or the air outlet port 36*b* and contaminates the support surface 13 or the medium 99.

In this regard, when there is the inside layer 33*a* that can suppress ventilation inside the heat insulating layer 33*b*, the water vapor in the air sending path 36 hardly enters the heat insulating layer 33*b*. Further, because the heat insulating layer 33*b* is positioned on the outside of the inside layer 33*a*, a temperature difference between the inside and the outside of the inside layer 33*a* is small. Therefore, even when a high temperature gas containing water vapor comes into contact with the inside layer 33*a*, dew condensation hardly occurs. On the other hand, a temperature difference between the inside and the outside of the of the heat insulating layer 33*b* may be large. However, if water vapor does not enter into the heat insulating layer 33*b*, dew condensation does not occur.

When a power source of the drying apparatus 30 is turned off, the air blower 37 is driven for a certain period of time after stopping drive of the heating mechanism 31. By doing this, it is possible to lower the temperature in the housing 32 while replacing gas in the air sending path 36. Therefore, dew condensation due to rapid cooling of the water vapor remained in the air sending path 36 in association with stopping the drive or operation of the heating mechanism 31 hardly occurs.

Thus, the condensation of water vapor can be substantially reduced or minimized. This prevents condensed liquid from dripping onto the medium or support surface.

According to the above embodiment, the effects described below can be obtained.

(1) When the printed medium 99 is transported onto the support surface 13, evaporation of a liquid attached to the medium 99 or in the printed matter or deposited liquid is accelerated by the wind or gas blown from the air outlet port 36*b* by driving the air blower 37 and by the heat generated by the heating mechanism 31. Even when the temperature in the air sending path 36 is raised by the heat generated by the heating mechanism 31, a temperature difference hardly occurs between the outside surface and the inside surface of the inside layer 33*a* located inside of the heat insulating layer 33*b*. Further, the inside layer 33*a* suppresses ventilation, so that water vapor hardly enters the heat insulating layer 33*b*, which is positioned outside of the inside layer 33*a* with respect to the air path. Therefore, dew condensation hardly occurs in the air sending path 36.

(2) Even when the temperature in the air sending path 36 is raised by the heat generated by the heating mechanism 31, a temperature difference hardly occurs between the outside and the inside of the inside layer 33*a* because the outer wall 33 includes the heat insulating layer 33*b*, which is inside the outside layer 33*c*. Therefore, dew condensation hardly occurs in the air sending path 36.

(3) The outer wall 33 may have a multi-layer structure (e.g., a three-layer structure) that includes two plate-like members and a heat insulating material sandwiched by these plate-like members. Therefore, the strength of the housing 32 is higher than the strength of the housing 32 when the heat insulating layer 33*b* is an air layer or a vacuum layer.

(4) When the wind or gas blown from the air outlet port 36*b* passes through the region heated by the heating mechanism 31, evaporation of a liquid attached to the medium 99 is accelerated. The air intake port 36*a* opening to the support surface 13 sucks heated gas flowing along the support surface 13, so that the temperature of the gas going out from the air outlet port 36*b* rises and heat efficiency is good. Even when water vapor generated from the medium 99 enters from the air intake port 36*a*, the inside layer 33*a* of the air sending path 36 suppresses ventilation, so that water vapor hardly enters the heat insulating layer 33*b*. Therefore, dew condensation hardly occurs in the air sending path 36.

The above embodiment may be changed to modified examples as described below. Components included in the above embodiment can be arbitrarily combined with components included in the modified examples described below. The components included in the modified examples described below can be arbitrarily combined with each other.

The drying apparatus 30 may be detachably attached to the printing apparatus 11.

The drying apparatus 30 may be housed in or inside of the housing 12 of the printing apparatus 11.

The air blower 37 may be arranged at the air intake port 36*a* and/or at the air outlet port 36*b*.

The heating element included in the heating mechanism 31 is not limited to the heater tube 31*a* but may be a heating wire or the like.

The heating mechanism 31 may heat gas in the air sending path 36. In this case, the drying apparatus 30 need not include the inner wall 34.

The outer wall 33 and the side wall 35 may have a multi-layer structure of four layers or more. For example, the heat insulating layers 33*b* and 35*b* may have two layers or more, or another plate-like member may be inserted between two heat insulating layers 33*b* and/or between two heat insulating layers 35*b*. Thereby, the strengths of the outer wall 33 and the side wall 35 increase. Further, as the number of layers constituting the outer wall 33 and the side wall 35 increase, a temperature difference between inside and outside or between inside surface and outside layer of each layer becomes smaller. Thus, dew condensation is suppressed.

The support surface 13 may be an inclined surface or a horizontal surface or may be an uneven surface.

The liquid ejected by the printing mechanism 20 is not limited to ink but may be, for example, a liquid body where particles of functional material are dispersed or mixed into a liquid. For example, the printing mechanism 20 may eject a liquid body containing a material such as an electrode material or a color material (pixel material) which are used to manufacture an EL (electroluminescence) display and a surface light emission display and which are dispersed or dissolved into the liquid body.

The printing mechanism 20 may be configured to attach a liquid to the medium 99 by coming into contact with the medium 99.

The printing apparatus 11 may be a page printer that performs printing for each page.

The drying apparatus 30 may be used to accelerate drying of something other than printed matter.

The medium 99 is not limited to a paper sheet (cut or continuous) but may be a plastic film such as a transfer film, or a thin plate member, or a fabric used by a printing apparatus.

Hereinafter, technical ideas grasped from the embodiment and the modified examples described above and operational effects thereof will be described.

Idea 1

A drying apparatus may include a heating mechanism arranged so as to heat a medium supported by a support surface, an air sending path that includes an air intake port through which outside air is introduced and an air outlet port that opens to the support surface, and an air blower arranged so as to flow gas in the air sending path toward the air outlet port.

The air sending path may include an inside layer that can suppress ventilation and a heat insulating layer that is arranged superimposed on an outside or an outside surface of the inside layer. The inside surface faces the air sending path in one example.

According to this configuration, evaporation of liquid is accelerated by wind or gas blown from the air outlet port by drive of the air blower and heat generated by the heating mechanism. Even when temperature in the air sending path is raised by the heat generated by the heating mechanism, a temperature difference hardly occurs between the outside and the inside (e.g., between the outside surface and the inside surface) of the inside layer located inside of the heat insulating layer. Further, the inside layer suppresses ventilation, so that water vapor hardly enters or reaches the heat insulating layer. Therefore, dew condensation hardly occurs in the air sending path.

Idea 2

The drying apparatus according to Idea 1, may further include a housing that houses the heating mechanism and the housing may have an outer wall that constitutes the air sending path or that defines at least a part of the air sending path. The outer wall may include the inside layer, the heat insulating layer, and an outside layer that is arranged superimposed on an outside of the heat insulating layer. In other words, the outside layer is positioned on or superimposed on an outside surface of the heat insulating layer.

According to this configuration, even when the temperature in the air sending path is raised by the heat generated by the heating mechanism, a temperature difference hardly occurs between the outside and the inside of the inside layer because the outer wall includes the heat insulating layer inside the outside layer. Therefore, dew condensation hardly occurs in the air sending path. Thus, the arrangement of the outer wall or layer, the heat insulating layer, and the inside layer help ensure that a temperature different between the outside and inside surfaces of the inner layer is small. The inside or inside surface refers, in one example, to the surface closest to the air flow path or that faces the air flow path. The outside or outside surface of any of the layers refers to the surface further from the air flow path than the inside surface. The outside or outside surface faces away from the air flow path.

Idea 3

The drying apparatus according to Idea 2, in which the inside layer and the outside layer are composed of a plate-like member, and the heat insulating layer is composed of a heat insulating material sandwiched by the inside layer and the outside layer.

According to this configuration, the outer wall may have a multi-layer structure (e.g., three-layer structure) composed of two plate-like members and a heat insulating material sandwiched by these plate-like members. Therefore, the strength of the housing is higher than the strength of the housing when the heat insulating layer is an air layer or a vacuum layer.

Idea 4

The drying apparatus according to any one of Ideas 1 to 3, in which the air intake port opens to the support surface, and the heating mechanism is arranged between the air outlet port and the air intake port.

According to this configuration, even when water vapor generated due to drying of the medium enters from the air intake port, the inside layer of the air sending path suppresses ventilation, so that water vapor hardly enters the heat insulating layer. Therefore, dew condensation hardly occurs in the air sending path.

Idea 5

A printing apparatus including a printing mechanism configured to perform printing on a medium, a support surface that can support the medium, a transport mechanism that transports the medium along the support surface, and the drying apparatus according any one of Ideas 1 to 4.

According to this configuration, when a printed medium is transported onto the support surface, the drying apparatus accelerates drying of the medium by heating the medium while blowing wind or gas (air). Even when temperature in the air sending path is raised by the heat generated by the heating mechanism, a temperature difference hardly occurs between outside and inside of the inside layer located inside of the heat insulating layer. Further, the inside layer suppresses ventilation, so that water vapor hardly enters the heat insulating layer. Therefore, dew condensation hardly occurs in the air sending path.

What is claimed is:

1. A drying apparatus comprising:

a heating mechanism arranged so as to heat a medium supported by a support surface;

an air sending path that includes an air intake port through which outside air is introduced and an air outlet port that opens to the support surface, wherein the air intake port is downstream of the air outlet port and the air outlet port is upstream of the heating mechanism; and an air blower arranged so as to flow gas in the air sending path toward the air outlet port, the air blower being positioned in the air sending path in a location that is upstream of the intake port and the heating mechanism and downstream of the outlet port, wherein the air blower is located closer to the outlet port than to the inlet port, wherein the air sending path includes an inside layer that includes a gas barrier property that is configured to suppress ventilation and a heat insulating layer that is arranged superimposed on an outside of the inside layer, and wherein the air sending path includes at least one bent portion, the air blower being located at the at least one bent portion.

2. The drying apparatus according to claim 1, further comprising:

a housing that houses the heating mechanism, wherein the housing includes an outer wall that constitutes the air sending path, and the outer wall includes the inside layer, the heat insulating layer, and an outside layer that is arranged superimposed on an outside of the heat insulating layer.

3. The drying apparatus according to claim 2, wherein the inside layer and the outside layer are each composed of a plate-like member, and the heat insulating layer is composed of a heat insulating material sandwiched by the inside layer and the outside layer.

4. A printing apparatus comprising:

a printing mechanism configured to perform printing on a medium;

a support surface that can support the medium;

a transport mechanism that transports the medium along the support surface; and the drying apparatus according to claim 1.

5. A printing apparatus comprising:

a printing mechanism configured to perform printing on a medium;

a support surface that can support the medium;

a transport mechanism that transports the medium along the support surface; and the drying apparatus according to claim 2.

6. A printing apparatus comprising:

a printing mechanism configured to perform printing on a medium;

a support surface that can support the medium;

a transport mechanism that transports the medium along the support surface; and the drying apparatus according to claim 3.

* * * * *